US005351622A

United States Patent [19]

Ekholm

[11] Patent Number: 5,351,622

[45] Date of Patent: Oct. 4, 1994

[54] SECUREMENT OF LINER FOR SHAPED CHARGE

[75] Inventor: Olof Ekholm, Karlskoga, Sweden

[73] Assignee: Bofors AB, Karlkoga, Sweden

[21] Appl. No.: 10,054

[22] Filed: Jan. 28, 1993

[30] Foreign Application Priority Data

Jan. 29, 1992 [SE] Sweden ..... 9200235

[51] Int. Cl.[5] ..... F42B 1/02; F42B 3/08; F42B 12/10

[52] U.S. Cl. ..... 102/476; 102/306

[58] Field of Search ..... 102/476, 475, 306, 307

[56] References Cited

U.S. PATENT DOCUMENTS

| | | | |
|---|---|---|---|
| 4,703,695 | 11/1987 | Langer | 102/476 |
| 4,776,278 | 10/1988 | Scholles et al. | 102/307 |
| 4,798,145 | 1/1989 | McVeagh | 102/306 |
| 4,922,825 | 5/1990 | Aubry et al. | 102/476 |
| 4,951,572 | 8/1990 | Böcker et al. | 102/476 |
| 5,153,373 | 10/1992 | Lips et al. | 102/476 |

FOREIGN PATENT DOCUMENTS

| | | |
|---|---|---|
| 3931169 | 3/1991 | Fed. Rep. of Germany . |
| 2046372 | 3/1992 | Fed. Rep. of Germany . |
| 1593370 | 7/1970 | France . |

*Primary Examiner*—David Brown
*Attorney, Agent, or Firm*—Pollock, Vande Sande & Priddy

[57] ABSTRACT

A method of securing a liner or inlay in an opening of a case surrounding a shaped explosive charge on all sides except for the opening, the opening facing the direction of the intended effect of the charge. The liner or inlay defines the shape of the charge in the direction of the intended effect of the charge. The method comprises immovably securing the liner or inlay in a direction parallel to the direction of the intended effect of the charge, and simultaneously resiliently securing the liner or inlay in a direction orthogonal to the direction of the intended effect of the charge, whereby a clearance is exists between an outer edge of the inlay or liner and an inner wall of the case.

11 Claims, 1 Drawing Sheet

SECUREMENT OF LINER FOR SHAPED CHARGE

FIELD OF THE INVENTION

The present invention relates to a method and an apparatus for securing or retaining inlays or liners which, forwardly in the effect direction, define the explosives in so-called shaped charges.

BACKGROUND OF THE INVENTION

The expression "shaped charges" is understood to mean charges for directed bursting or hollow charge effect. These charges consist of an explosive charge enclosed in a container or case and defined, forwardly in the direction of the intended effect by inlays or liners which are of a concave bulging, conical or trumpet-shape. On detonation of the rearwardly located explosive charge, these liners or inlays are converted into particle jets or more or less projectile-like slugs which, at supersonic speeds, are flung forwards in the intended effect direction of the charge. It is primarily the shape and material of the liner or inlay that which determines whether the main effect of a shaped charge is of the nature of a jet or a projectile. The most common material used for the liner or inlay is pure copper, but other metals such as iron, spent uranium, aluminium and tantalum have also been employed.

Ammunition must be capable of withstanding extreme temperature variations without its function being tangibly affected. As long as the shaped charge inlays were made of pure copper and the rest of the case surrounding the explosive charge was of steel, problems of temperature variation were not excessively difficult to solve, since steel and copper do not, after all, have all too different coefficients of thermal expansion.

However, now that there is a steady trend towards producing shaped charge inlays from tantalum in order to satisfy the demands placed on the efficiency of the charge, the problem of temperature variation becomes more acute. In particular, as the shaped charge inlays are intended to be permanently mounted in the steel case which generally surrounds the explosive charge portion included in the shaped charge on all sides except in the intended effect direction where the inlay or liner forms the concave cavity in the explosive substance that gives rise to the directed explosive effect. The reason for this is that tantalum and steel display large differences in thermal expansion. Previously, the inlays have normally been secured in shaped charges by means of a screw ring threaded in the mouth of the steel case and fixedly clamping the inlay against a folded edge in the case. Provided that the clearance between the wall of the case and the inlay is not too large, this securement method gives the permanent securement of the inlay that has been deemed necessary for the satisfactory functioning of the shaped charge. However, it is known in the art that the reforming of the inlay into a projectile or particle jet on detonation of the explosive charge is affected by the anchorage ring and the securement fold along that edge zone which, as it were, is shielded from the explosive since this does not reach all the way out to the outer edge of the inlay.

Now that the inlay is to be manufactured of tantalum, as this material gives an amplified effect as compared with the previously used copper, and the rest of the sleeve surrounding the explosive is made of steel, a clearance of 0.01 mm between inlay and case at ~20° C. would cause the inlay to suffer from a subsequently permanent change in shape if the charge were to be exposed to a temperature of −40° C., a circumstance which must be considered as fully conceivable at any rate in cold climates such as in Sweden.

If greater clearance is to be permitted between the inlay and case, the folded edge and the screw ring fixedly clamping the inlay must be given a larger surface area which, in both cases, means parameters that negatively influence the effect of the charge on the target, as a larger portion of the inlay will then be shielded from the explosive.

SUMMARY OF THE INVENTION

According to the present invention, this problem is now solved with the aid of a resiliently yieldable securement of the inlay that can compensate for the temperature movements of the different materials. However, this cannot be put into effect by any means whatever, as the effect of the charge must not be negatively influenced.

Accordingly, the present invention may be defined as a method and an apparatus for securing in shaped charges the liner or inlay limiting the explosive portion of the charge forwardly in the effect direction, in the opening to the case surrounding the rest of the explosive portion. This opening also is directed forwardly in the effect direction. According to the present invention, this securement is rendered immobile in the axial direction, at right angles to the intended effect direction of the charge, but resiliently yieldable in the radial direction, parallel with the intended effect direction of the charge, and with a clearance between the inlay's own outer edge and the inner wall of the case.

The radially resiliently yieldable securement permits necessary temperature movements between inlay and case, while the axially immobile securement must be so powerful as to be capable of absorbing the substantial acceleration and retardation stresses to which the charge can be subjected. The charge is, indeed, often included as a part in an artillery projectile or a missile. It further applies that shaped charges, as a rule, are of circular cross-section, and a further development of the present invention relates to shaped charges of this type, as will be disclosed in greater detail below. However, there are also shaped charges, which are of rectangular cross-section, in which event the present invention applies in its most generic form as defined in the foregoing, even though the expression "radial direction" may not perhaps then be fully adequate, but instead the definition "at right angles to the intended effect direction" should rather apply.

In shaped charges of circular cross-section, it now applies that the inlay or liner according to the present invention is secured in the case by means of an anchorage ring which is connected with the inlay and produced from resiliently yieldable material such as high-grade steel: The ring displays a first, inner, inwardly flaring frusto-conical shank collar extending in towards the case and the place for the explosive therein: This inner collar has a small top angle which, in a direction towards the case, is terminated by an annular inner support edge, which faces away from the inlay. The outside diameter of the angular inner support is at least somewhat larger than the outside diameter of the inlay and is adapted to the inside diameter of the case. The ring also displays an outer, similarly frusto-conical shank collar which faces in the opposite direction and flares outwardly. This outer collar has a small top angle which is outwardly terminated by an outwardly facing, annular outer support edge.

This basic design thus gives inwardly and outwardly facing support edges, which each terminate a frusto-conical, an almost collar-shaped portion here designated shank collars. Since these collars have small top angles, the main direction of their walls will be quite close to but not parallel with the inside of the case. Also since the inlay is connected to the anchorage ring where its shank collars have their smallest diameter, the anchorage ring will, as it were, have a rigid waist in which the inlay is secured. The inwardly and outwardly extending frusto-conical skirt portions or shank collars which, by being manufactured as a unit from a resiliently yieldable material, can be deformed and somewhat expanded respectively along the support edges. On the other hand, their main direction is, thanks to the small top angles, close on parallel with the longitudinal direction of the case, for which reason no movement in that direction can take place unless each respective shank collar collapses altogether, which can be avoided in that maximum acceleration and retardation forces are taken into account on mechanical strength calculations. The diameters of the outer and inner support edges of the shank collars are further both at least slightly larger than the diameter of the inlay and are further in turn adapted to the inside diameter of the case. By this means, a certain clearance will be guaranteed between the outer edge of the inlay, i.e. in practice the waist of the anchorage ring, and the inside of the case.

On mounting the inlay in position, it is passed down into the case secured in the support ring until the inner support edge of this latter at the inner shank collar abuts against an annular stop edge formed in the inside of the case, and thereafter the outer shank collar is upset, or alternatively by yielding is snapped in so that its outer support edge abuts against an outer stop edge similarly formed on the inside of the case. The inlay is thus tensioned in between these two mutually counter directed stop edges between the simultaneously pretensioned shank collars. The stop edges in the case wall may consist of, for instance, the two opposing edge sides of one and the same groove formed in the case wall.

Once the inlay or liner has been mounted in place, the case behind the liner is filled with explosive. Thus, the explosive will support the inlay and assist in absorbing the acceleration forces in one direction. In order to compensate for the lack of support of the inlay in the intended effect direction of the charge, i.e. outwardly, it may be appropriate to manufacture the outer shank collar with a stiffer resilience than the inner. This may, for instance, be effected by giving this collar a somewhat shorter free length.

To retain the inlay in the anchorage ring, this is ideally provided with an annular groove flush with its own waist. The anchorage ring may be made of profile rolled and welded strip material or perhaps, even more suitable, directly from a tubular material which is cut and tapered, and provided with the groove for the inlay.

BRIEF DESCRIPTION OF THE DRAWINGS

The present invention has been defined in the appended claims and will now be described in greater detail hereinbelow with particular reference to the accompanying drawings which, in FIG. 1, show a longitudinal section through a shaped charge of circular cross-section, and, in FIG. 2, show a detail on a larger scale of the securement of the anchorage ring in the case. anchorage ring in the case.

This latter figure shows the charge before the case included therein has been filled with explosive.

DETAILED DESCRIPTION OF PREFERRED EMBODIMENT

Figure 1:
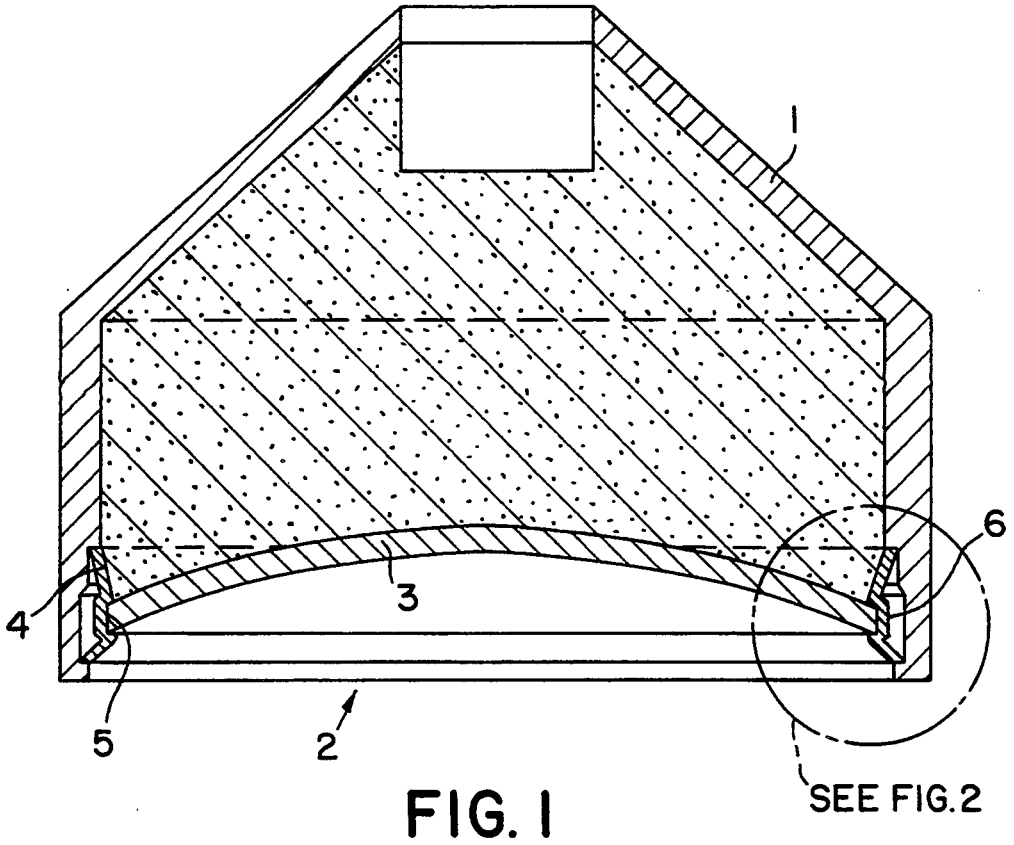

The shaped charge shown in the drawings consists of a steel case 1 in whose mouth 2 open in the intended effect direction a tantalum inlay or tantalum liner 3 is secured by means of an anchorage ring 4. The inlay or liner 3 is, along its periphery, secured in a groove 5 in an anchorage ring 4. The anchorage ring is, in its turn, secured in a groove 6 which has been milled from the inner wall of the case 1 proximal the opening of the mouth 2.

Figure 2:
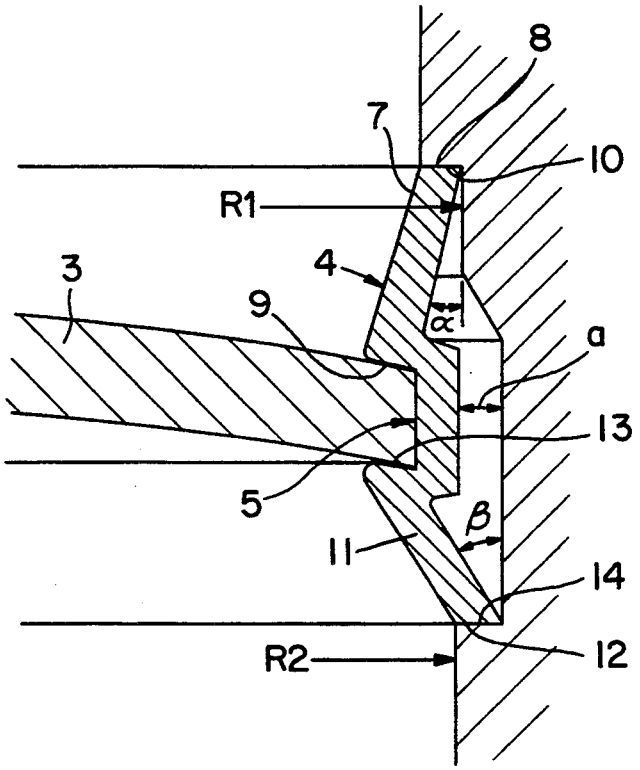

The details intimately related to the anchorage ring and the securement thereof in the case are most readily apparent from FIG. 2.

As is apparent from FIG. 2, the anchorage ring 4 includes, first, the groove 5 in which the inlay is secured and, secondly, an inner shank collar 7 which is in the form of a short truncated cone with a slight top angle which flares inwardly and whose inside is, thus, not parallel with the inside of the case but deviates at most about 10–15 degrees from the main angle thereof (the angle $\alpha$). Thus, the shank collar is extremely rigid in a direction parallel to the main direction of the case which, in turn, coincides with the intended effect direction of the charge. The shank collar 7 is terminated inwardly by an annular support edge 8 facing away from the inlay 3. The support edge 8 has an outside diameter R 1. In the groove 5, there is a second support edge 9 along which the inlay is supported by the anchorage ring 4. In its turn, the support edge 8 abuts tight against an opposing stop edge 10 in the groove 6. Like the support edge 8, the stop edge 10 has the outside diameter R 1. In addition, the support and stop edges 8 and 10 are of the same width. The inlay 3 is, hence, extremely rigidly supported in a direction in towards the interior of the case 1 along its periphery via the support edge 9, the shank collar 7, the support edge 8 and the stop edge 10.

Correspondingly, the ring is formed, in an outward direction in the intended effect direction, with a frusto-conical outwardly flaring, outer shank collar 11 which is terminated by an outer annular support edge 12 making an angle $\beta$ with the inside of the case and having a support edge 13 against the inlay and abutting against the stop edge 14 in the groove 6. The inside diameter R 2 of the stop edge 14 is at least as large as R 1, this so as to enable the anchorage ring 4 to pass the stop edge 14 when the anchorage ring 4 is mounted in place. Hence, the groove 6 has an inner lesser diameter R 1 and an outside diameter equal to R 2 plus the width of the support surface 12. This latter is equal to the thickness of the outer shank collar 11. On mounting, the support ring 4 is passed in the groove 6 until the support and stop edges 8 and 10 abut against one another, whereafter the shank collar 11 is sprung or upset outwardly so that the support and stop edges 12 and 14 abut against one another. The shank collar 11 has the same frusto-conical main form as its inner counter form as its inner counterpart 7, but it is somewhat shorter and thereby more rigid than this. This is because the inlay 3 is supported inwardly by the explosive but is wholly without support in an outward direction.

The anchorage ring 4 is thus tensioned in between the annular stop edges 10 and 14 via its own annular support edges 8 and 12.

As is apparent from the figure, the anchorage ring 4 has a waist flush with the groove 5 and clearance is there formed between the inside of the anchorage ring and the inside of the case groove 6. Thus, there are possibilities here to absorb the main differences in temperature movements between the materials tantalum in the inlay 3 and steel in the case 1.

As a consequence of its particular design, the securement of the inlay is, on the one hand, movable in the radial direction, and, on the other hand, rigid in the axial direction and also compensated for different stresses in different axial directions. Finally, the inlay is also tight.

The specific sealing ring requires high-grade resilient material and is also far from easy to manufacture, but it does fulfil several different functions and is therefore well worth its cost.

The present invention should not be considered as restricted to that described above and shown on the drawings, many modifications being conceivable without departing from the spirit and scope of the appended claims.

What we claim and desire to secure by Letters Patent is:

1. A method of securing a liner or inlay in an opening of a case, said case having a different coefficient of thermal expansion than said liner or inlay, said case surrounding a shaped explosive charge on all sides except for said opening, said opening facing the direction of the intended effect of the charge, said liner or inlay defining the shape of the charge in the direction of the intended effect of the charge, said method comprising:

immovably securing said liner or inlay in said case in a direction parallel to the direction of the intended effect of the charge;

simultaneously resiliently securing said liner or inlay in a direction orthogonal to the direction of the intended effect of the charge; and providing a clearance for radial expansion of said inlay or liner between an outer edge of the inlay or liner and an inner wall of the case.

2. The method according to claim 1, further including the steps of:

making said inlay or liner with a circular outer profile and a cylindrical shape;

providing an anchorage ring made of a resiliently yieldable material and having an annular inner support edge and annular outer support edge;

securing said anchorage ring about a perimeter of the inlay or liner;

securing said inlay or liner in said case with said anchorage ring by mounting said inlay and said anchorage ring within said case, by introducing said inlay and said anchorage ring into said case until said annular inner support edge abuts against a first stop edge formed in said case, and urging said outer annular support edge into abutment against a second stop edge formed in said case.

3. The method according to claim 1, further comprising the steps of:

making said inlay or liner with a circular outer profile and a cylindrical shape terminated by an annular inner and annular outer support edge;

providing an anchorage ring made of a resiliently yieldable material;

forming in said anchorage ring a groove for receiving and supporting said inlay or liner;

forming in said anchorage ring a first, inner, frustoconical shank collar adjacent said groove, extending toward an inner wall of said case and said explosive charge, and with a maximum diameter greater than a outside diameter of the inlay or liner;

terminating said inner frustoconical shank collar with said annular inner support edge such that said annular inner support edge faces away from the inlay or liner forming in said anchorage ring a second, outer, frustoconical shank collar adjacent said groove on an opposite side from said inner collar, said outer collar being formed so as to extend outwardly toward an inner wall of the case in the direction of the intended effect of the charge, the outer collar formed to as to be angled slightly with respect to the inner wall of the case;

terminating the outer collar with said annular outer support edge such that said annular outer support edge faces away from the inlay or liner;

forming the outer support edge with a maximum diameter larger than an outside diameter of the inlay or the liner;

securing said anchorage ring about a perimeter of the inlay or liner such that said inlay or liner is secured in said groove;

securing said inlay or liner in said case with said anchorage ring by mounting said inlay and said anchorage ring within said case by introducing said inlay and said anchorage ring into said case until said annular inner support edge abuts against a first stop edge formed in said case and abuts against an inside wall of said case; and urging said outer annular support edge into abutment against a second stop edge.

4. An apparatus for securing a liner or inlay in an opening of a case, said case surrounding a shaped explosive charge on all sides except for at said opening, said opening facing the direction of the intended effect of the charge, said liner or inlay defining the shape of the charge in the direction of the intended effect of the charge, said apparatus comprising:

means for securing said liner or inlay within said opening of said case, said securing means being disposed about an outer edge of the inlay or liner, said securing means being rigid in a direction parallel to the direction of the intended effect of the charge, said securing means being resiliently yieldable in a direction orthogonal to the direction of the intended effect of the charge; and a gap provided between an outer edge of the inlay and an inner wall of the case for allowing radial expansion of said securing means.

5. An apparatus according to claim 4, said means for securing including a member having at least two angled portions adjacent opposite sides of said inlay or liner and forming acute angles with an inner wall of the case, at room temperature said angled portions maintaining the liner or inlay separated from the inner wall of the case, said at least two angled portions including a first angled portion directed in a substantially forward direction relative to the direction of the intended effect of the charge and a second angled portion being directed in a substantially rearward direction relative to the direction of the intended effect of the charge.

6. The securing apparatus according to claim 4, wherein said securing means comprises an anchorage ring made from resiliently yieldable material, and secured about a perimeter of the liner or inlay, said anchorage ring comprising:

a first angled portion including a first, inner, frustoconical shank collar extending away from said inlay or liner toward a wall of said case and toward said explosive charge, said inner collar being slightly angled in relation to the wall of said case, said inner collar being terminated by an annular inner support edge which faces away from the inlay or liner, said inner support edge having an outer diameter larger than an outside diameter of the inlay or liner, said inner support edge abutting an inside diameter of the case against a counter-directed first stop edge formed in the inner wall of the case; and a second angled portion comprises a second, outer frustoconical shank collar extending outwardly away from said inlay or liner toward the inner wall of the case and extending in the direction of the intended effect of the charge, said outer collar being angled slightly with respect to the inner wall of the case, the outer collar is terminated by an annular outer support edge which faces away from the inlay or liner, the outside diameter of said outer support edge being larger than the outside diameter of the inlay or the liner, the outer support edge being intended to be moved into abutment against a second, counter-directed stop edge formed in the inner wall of the case.

7. The securing apparatus according to claim 6, wherein said anchorage ring is formed of high-grade steel.

8. The securing apparatus according to claim 6, wherein the anchorage ring also includes an inwardly facing annular groove formed between said inner collar and said outer collar, wherein the outer periphery of the inlay or liner is fixedly retained in the annular groove when the inlay or liner is united with the anchorage ring.

9. The apparatus according to claim 6, wherein said anchorage ring is inwardly terminated by a support edge, said support edge having an outer periphery small enough to pass through a mouth of said case, said outer shank collar having a larger outside diameter than the inner support edge, and an outer portion of the groove being adapted to the larger outside diameter.

10. The securing apparatus according to claim 6, wherein said outer shank is more rigid than said inner shank collar.

11. The apparatus according to claim 10, wherein said outer shank collar is shorter than said inner shank collar.

* * * * *